US006084341A

United States Patent [19]

Takemura

[11] Patent Number: 6,084,341

[45] Date of Patent: Jul. 4, 2000

[54] ELECTRIC FIELD EMISSION COLD CATHODE

[75] Inventor: Hisashi Takemura, Tokyo, Japan

[73] Assignee: NEC Corporation, Tokyo, Japan

[21] Appl. No.: 08/912,645

[22] Filed: Aug. 18, 1997

[30] Foreign Application Priority Data

Aug. 23, 1996 [JP] Japan ..... 8-222199

[51] Int. Cl.[7] ..... H01J 1/30

[52] U.S. Cl. ..... 313/336; 313/351; 313/309; 313/495; 257/11

[58] Field of Search ..... 313/336, 351, 313/309, 495; 315/169.1, 169.3, 167; 257/11, 102, 103

[56] References Cited

U.S. PATENT DOCUMENTS

| | | | |
|---|---|---|---|
| 4,513,308 | 4/1985 | Greene et al. | 357/55 |
| 4,990,766 | 2/1991 | Simms et al. | 313/336 |
| 5,162,704 | 11/1992 | Kobori et al. | 315/349 |
| 5,359,256 | 10/1994 | Gray | 313/169 |
| 5,550,435 | 8/1996 | Kuriyama et al. | 313/336 |

FOREIGN PATENT DOCUMENTS

| | | |
|---|---|---|
| 0316214 | 5/1989 | European Pat. Off. . |
| 0550335 | 7/1993 | European Pat. Off. . |
| 0572170 | 12/1993 | European Pat. Off. . |
| 0596242 | 5/1994 | European Pat. Off. . |
| 0651417 | 5/1995 | European Pat. Off. . |
| 2698992 | 6/1994 | France . |
| 4-249026 | 9/1992 | Japan . |
| 5-205612 | 8/1993 | Japan . |
| 6-176686 | 6/1994 | Japan . |
| 7-130281 | 5/1995 | Japan . |
| 8-87957 | 4/1996 | Japan . |
| 8-162005 | 6/1996 | Japan . |
| 9-185941 | 7/1997 | Japan . |
| 10-12129 | 1/1998 | Japan . |
| 10-50205 | 2/1998 | Japan . |
| WO9112624 | 8/1991 | WIPO . |

*Primary Examiner*—Ashok Patel
*Attorney, Agent, or Firm*—Sughrue, Mion, Zinn, Macpeak & Seas, PLLC

[57] ABSTRACT

An electric field emission cold cathode which is free of short-circuited damage upon discharge is provided by forming a highly voltage-withstandable control mechanism, which is capable of limiting generation of current upon discharge, with a simple structure and through simple fabrication processes. The electric field emission cold cathode includes a sharp-pointed emitter, a gate electrode having an aperture surrounding the emitter, and a cathode electrode connected to the emitter. The electric field emission cold cathode further includes an n-type diffused layer connected to the emitter and the cathode electrode, and a p-type silicon substrate electrically connected to the cathode electrode at least at a side thereof facing the emitter. A pinch-off resistor is provided between the emitter and the cathode electrode. The pinch-off resistor has a saturation current value smaller than a short-circuit breakdown current of the emitter.

8 Claims, 10 Drawing Sheets

ELECTRIC FIELD EMISSION COLD CATHODE

BACKGROUND OF THE INVENTION

This invention relates to an electric field emission cold cathode having a current limiting element connected to an emitter, and further relates to a display device using the electric field emission cold cathode as an electron gun.

An electric field emission cold cathode is an element for concentrating the high electric field at the tip of a sharp-pointed conical emitter using the emitter and a gate electrode having an aperture of size on the order of submicrons and formed adjacent to the emitter, so as to emit electrons from the tip of the emitter under vacuum. In the electric field emission cold cathode, since the emitter and the gate electrode are located quite close to each other, the large flow of current may occur in the emitter due to discharge induced by gas or the like during operation so that a material of the emitter is melted to cause a short circuit between the emitter and the gate electrode. As a countermeasure for this, there was developed an element with a resistance layer which was formed in series with an emitter for limiting the current upon discharge so as to prevent the melt damage of the emitter. However, in this method, there was a problem of increase in operating voltage caused by the potential drop across the resistance layer even during a normal operation other than upon discharge.

Under these circumstances, there has been proposed a method, wherein an active element having a saturation current characteristic is formed at an emitter for controlling the current flowing in the emitter. Conventional electric field emission cold cathodes of this type have structures as shown in FIGS. 1 and 2, which are disclosed in, for example, Japanese Unexamined Patent Publications (A) Nos. 130,281 of 1995 and 249,026 of 1992.

The first conventional electric field emission cold cathode shown in FIG. 1 will be first explained. FIG. 1 is a sectional view of the first conventional electric field emission cold cathode. In FIG. 1, the electric field emission cold cathode includes sharp-pointed conical emitters 7*a* (only one is shown) made of molybdenum (Mo), a gate electrode 4*b* made of tungsten (W) and surrounding the emitters 7*a*, an insulation film 3 in the form of an oxide film, an n-type silicon 17 connected to the emitters 7*a*, a p-type silicon 16 surrounding the n-type silicon 17, and a p-type leading electrode 4*c* made of W and connected to the p-type silicon 16, which are formed on an n-type silicon substrate 11 connected to a substrate electrode 8 working as a cathode electrode. In this prior art, the n-type silicon 17, the p-type silicon 16 and the n-type silicon substrate 11 form a junction field effect transistor and, by changing the voltage applied to the p-type silicon 16, the current flowing in the n-type silicon 17 can be controlled. Further, for ensuring voltage-withstanding, the concentration and depth of the n-type silicon 17 between the emitter 7*a* and the n-type silicon substrate 11 are set so as not to be applied with a electric field intensity greater than the breakdown electric field intensity of silicon.

Now, the second conventional electric field emission cold cathode shown in FIG. 2 will be explained. FIG. 2 is a sectional view of the second conventional electric field emission cold cathode. In FIG. 2, the electric field emission cold cathode includes sharp-pointed conical emitters 7*a* (only one is shown) made of molybdenum (Mo), a gate electrode 4*b* made of W and surrounding the emitters 7*a*, a cathode electrode 4*a*, an insulation film 3 in the form of an oxide film, an $n^+$-type silicon 18, an n-type silicon 17 and an insulated gate field effect transistor (IGFET) gate 19, which are formed on a p-type silicon substrate 1. In this prior art, the n-type silicon 17, the $n^+$-type silicon 18, the p-type silicon substrate 1, the cathode electrode 4*a* corresponding to a source electrode and the IGFET gate 19 form an IGFET and, by changing the voltage applied to the IGFET gate 19, the current value can be controlled. Further, for setting a withstand voltage of the IGFET to be not less than a voltage between the gate electrode 4*b* and the emitter 7*a* (cathode electrode 4*a*) upon electron emission, the n-type silicon 17 is used as a pinch-off resistor for suppressing voltage increase of the $n^+$-type silicon 18 connected to the emitter 7*a* so as to ensure the voltage-withstanding.

In the foregoing conventional method wherein the current value is controlled by the active element, the first drawback is that, for controlling the current value, the element is enlarged, peripheral circuits of a device using the element are increased and thus the whole device structure becomes complicated. Specifically, the additional electrode and a power supply connected thereto are required for controlling the current value other than the cathode electrode, the gate electrode (and an anode electrode for receiving emitted electrons) and independent power supplies connected thereto, which are necessary for the normal electric field emission cold cathode. The first conventional electric field emission cold cathode requires the p-type leading electrode 4*c* for controlling the voltage applied to the p-type silicon 16, and the second conventional electric field emission cold cathode requires the IGFET gate 19. Particularly, in the second conventional electric field emission cold cathode, the element requires a gate oxide thin film under the IGFET gate 19 and further requires the IGFET gate 19 separately from the gate electrode 4*b* and the cathode electrode 4*a* so that the element structure becomes complicated.

The second drawback is that, for ensuring the voltage-withstanding when the current flows in a depth direction from the emitter 7*a* to the substrate electrode 8 corresponding to a cathode electrode in the first conventional electric field emission cold cathode, it is necessary to form the n-type silicon 17, whose current is controlled by the p-type silicon 16, so as to have a depth of not less than 10 $\mu$m over a constant width. However, this is difficult in view of fabrication. Specifically, when forming the n-type silicon using the diffusion method, since expansion occurs in a width direction as advancing deeper, it is difficult to achieve the constant width. Even when the ion implantation method is used, since expansion in a width direction differs in a depth direction, it is necessary to carry out the implantation in a plurality of times and further, implantation masks become thicker so that the fabrication processes become complicated and take time.

The third drawback is that, when using the n-type silicon 17 as the pinch-off resistor for ensuring the voltage-withstanding in the second conventional electric field emission cold cathode, the resistance value (current value) is liable to change depending on the voltage applied to the gate electrode 4*b* so that the operation becomes unstable. This is caused by the fact that, since the gate electrode 4*b* with the positive potential higher than the emitter 7*a* is provided over the n-type silicon 17, an accumulation layer of n-type electrons is formed at the side of the n-type silicon 17 adjacent to the insulation film 3 to reduce the pinch-off resistance of the n-type silicon 17 so that the current value to be controlled changes depending on the gate voltage.

The fourth drawback is that, although the withstand voltage of the element using the conventional active element is set to be not less than the voltage applied between the emitter 7*a* and the gate electrode 4*b* upon electric field emission, since there is no limit to the flow of current per emitter, the damage upon discharge can not be prevented. The reason for this is that, according to the researches made by the present inventor, if the current not less than 10 mA flows per emitter of Mo on the silicon substrate upon an occurrence of discharge between the emitter and the gate electrode, the emitter is melted to cause a short circuit relative to the gate electrode. Accordingly, in the foregoing prior art, even if the elements are partly damaged, the remaining elements may be free of damage and normally operated, however, it is difficult to prevent an occurrence of short-circuited damage itself.

SUMMARY OF THE INVENTION

It is therefore an object of this invention to provide an electric field emission cold cathode which is free of short-circuited damage upon discharge, wherein addition of an electrode or a power supply for the formation of an active element can be suppressed, and a highly voltage-withstandable control mechanism which is capable of limiting generation of current upon discharge can be formed with a simple structure and through simple fabrication processes.

An electric field emission cold cathode according to this invention comprises a sharp-pointed emitter, a gate electrode having an aperture surrounding the emitter, and a cathode electrode connected to the emitter, wherein a pinch-off resistor having a saturation current characteristic is formed by an n-type silicon film connected to the emitter and the cathode electrode and a p-type silicon film electrically connected to the cathode electrode at a side thereof facing the emitter.

OPERATION OF THE INVENTION

According to this invention, an n-type diffused layer connected to an emitter extends laterally from the emitter so as to be connected to a cathode electrode which supplies current upon emission of electrons from the emitter. The n-type diffused layer contacts a p-type layer at least at a side thereof remote from a side where the n-type diffused layer is connected to the emitter. The p-type layer is electrically connected to the cathode electrode. Since the potential of the emitter increases upon discharge between the emitter and a gate electrode, the potential of the n-type diffused layer increases in the neighborhood of the emitter so that a potential difference is caused between the n-type diffused layer and the contacting p-type layer. Thus, a depletion layer expands from the p-type layer to cause the pinch-off in the neighborhood of the emitter so that a pinch-off resistor is provided to suppress the current amount supplied from the cathode electrode. This makes it possible to limit the current flowing in the emitter to a value smaller than the current amount at which a material of the emitter is melted. This current limitation can be easily achieved since the pinch-off resistor formed by the n-type diffused layer extends laterally. Further, since the element is formed without incorporating an active element, addition of an electrode or an external power supply can be minimized so that a finer structure of the element and simplification of the device can be achieved.

Further, by forming a p-type layer on the emitter-side surface of the n-type diffused layer abutting an insulation film under the gate electrode, variation of a characteristic of the pinch-off resistor due to fluctuation of the voltage applied to the gate electrode can be reduced.

Further, by setting a pinch-off resistor characteristic so as to allow the current, which flows in the n-type diffused layer, to take a value smaller than a short-circuit breakdown current of the emitter, for example, smaller than 10 mA in case of the emitter made of Mo, it is possible to prevent the damage to the element which would be otherwise caused by a short circuit between the emitter and the gate electrode due to melting of the emitter so that the reliable element free of damage can be formed.

Further, by applying the electric field emission cold cathode, which has a saturation current characteristic achieved by the pinch-off resistor, to a display device, such as a flat panel display or a cathode ray tube for display, the display device with a long duration can be provided.

MERITS OF THE INVENTION

This invention provides an electric field emission cold cathode, wherein a p-type diffused layer or the like electrically connected to a cathode electrode contacts an n-type diffused layer or the like connected to an emitter, and the n-type diffused layer is operated as a pinch-off resistor when the high voltage is applied upon an occurrence of discharge between the emitter and a gate electrode, so as to prevent the current, not less than a current value at which a material of the emitter is melted, from flowing into the emitter by means of a saturation current characteristic of the pinch-off resistor.

The first effect of this invention is that, since the control of the maximum value of current flowing in the emitter is not performed using an active element which requires addition of an external power supply, the structures of the element and the device can be simplified. This leads to not only size reduction of the element or the device, but also lower power consumption of the device since a power circuit is not required.

The reason for this is that the current control is performed only by the pinch-off resistor formed between the cathode electrode and the sharp-pointed emitter. The saturation current characteristic of the pinch-off resistor is achieved by connecting the p-type diffused layer abutting the n-type diffused layer or the like to be pinched off, to the cathode electrode. Therefore, an external input electrode is not required.

The second effect of this invention is that the stable saturation current characteristic can be achieved with a simple structure and through simple fabrication processes, and thus, the reliable element free of damage to the element, such as damage due to a short circuit between the gate electrode and the emitter, can be provided.

The reason for this is that the pinch-off resistor formed by the n-type diffused layer or the like extends laterally. With this arrangement, for example, it is possible, through simple processes, to form the pinch-off resistor having a length not less than 10 $\mu$m which is required for ensuring a withstand voltage not less than 100V. Further, by forming the p-type diffused layer also at a side of the n-type diffused layer (pinch-off resistor) facing the gate electrode, a conductive layer, which would be otherwise produced at the surface of the n-type diffused layer due to influence of the gate electrode, is not produced so that the stable pinch-off characteristic can be achieved. With this arrangement where the n-type diffused layer is sandwiched between the p-type layers, since the pinch-off occurs from the upper and lower sides of the n-type diffused layer, the pinch-off characteristic can be improved. Further, by setting the saturation current value of the pinch-off resistor formed by the n-type diffused layer or the like to be smaller than 10 mA, the short-circuited damage of the emitter due to melting is not caused even upon an occurrence of discharge between the emitter and the gate electrode.

Further, by electrically separating the n-type diffused layer or the n-type epitaxial layer, damage to the element upon discharge can be prevented with respect to a desired current value. Specifically, by setting a saturation current value of each of pinch-off resistors formed by separated portions of the n-type diffused layer or the n-type epitaxial layer to be smaller than a short-circuit breakdown current upon discharge, such as 10 mA at which Mo is melted, a desired total operating current value can be achieved in the whole element.

Further, by applying the electric field emission cold cathode of this invention to a display device, the display device with a long duration can be achieved.

BRIEF DESCRIPTION OF THE DRAWINGS

FIGS. 13A and 13B are graphs for explaining a current characteristic achieved by this invention, wherein FIG. 13A shows a relationship between voltage applied to an emitter and current, and FIG. 13B shows a relationship between length of a p-type diffused layer and saturation current thereof.

DESCRIPTION OF THE PREFERRED EMBODIMENT

Now, an embodiment of this invention will be described with reference to the drawings.

Figure 1:
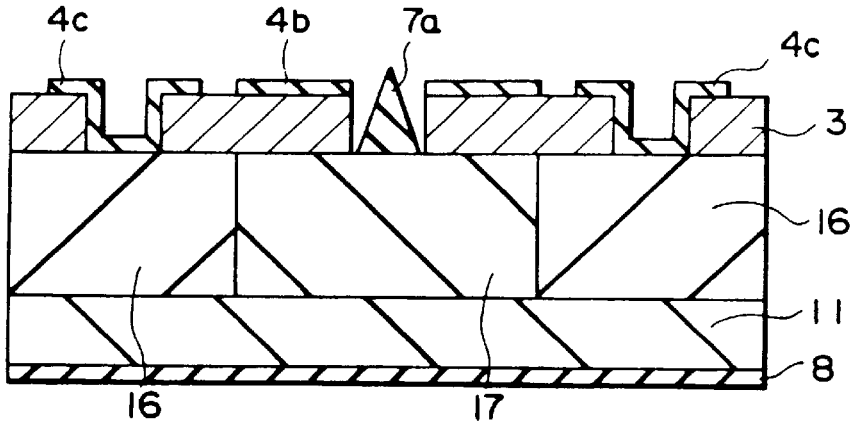
FIG. 1 PRIOR ART
FIG. 1 is a sectional view of a first conventional electric field emission cold cathode.
Figure 2:
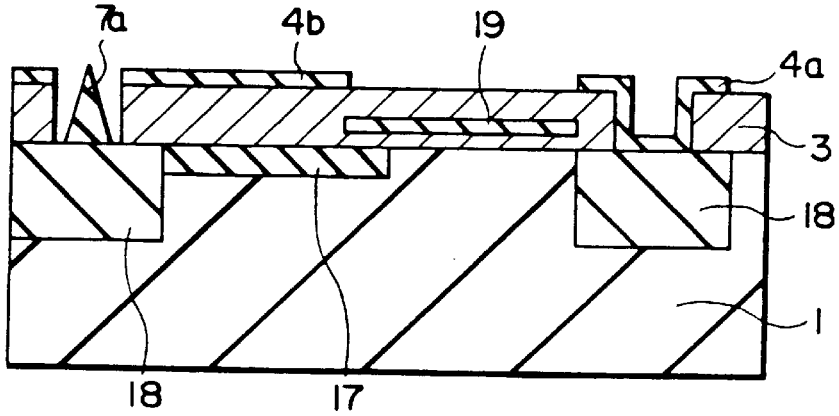
FIG. 2 PRIOR ART
FIG. 2 is a sectional view of a second conventional electric field emission cold cathode.
Figure 3:
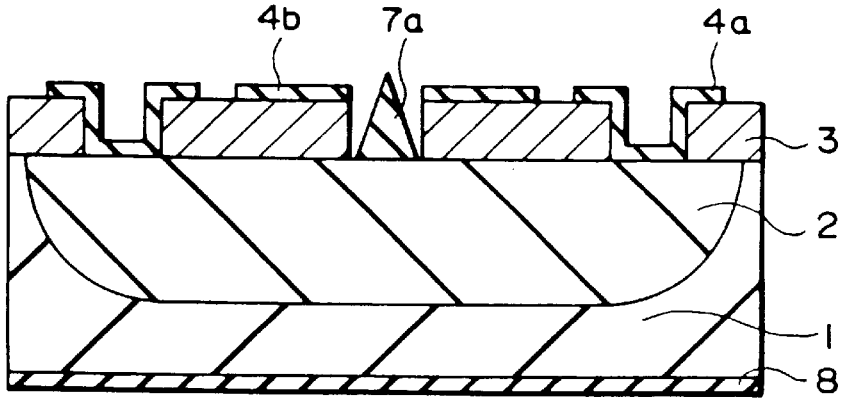
FIG. 3 is a sectional view of an electric field emission cold cathode according to an embodiment of this invention.

FIG. 3 is a sectional view of an electric field emission cold cathode according to the embodiment of this invention. Referring to FIG. 3, the electric field emission cold cathode includes a sharp-pointed emitter 7*a*, a gate electrode 4*b* surrounding the emitter 7*a*, an insulation film 3, an n-type diffused layer 2 connected to the emitter 7*a*, and a cathode electrode 4*a* connected to the n-type diffused layer 2, which are formed on a p-type silicon substrate 1 connected to a substrate electrode 8. As described, the emitter 7*a* which emits electrons and the cathode electrode 4*a* are connected via the n-type diffused layer 2, and the current amount flowing in the emitter 7*a* is determined by a resistance characteristic of the n-type diffused layer 2. By setting the p-type silicon substrate 1 and the cathode electrode 4*a* at substantially the same potential, when the high voltage is applied to the emitter 7*a*, a depletion layer expands in the n-type diffused layer 2 from the junction with the p-type silicon substrate 1 and the n-type diffused layer 2 is fully depleted in the neighborhood of the emitter 7*a* so as to work as a pinch-off resistor. As a result, during the normal operation, since the large voltage is not applied between the emitter and the cathode electrode, the expansion of a depletion layer is small and the operation is carried out in the low-current region so that the current is not limited. On the other hand, upon discharge, since the emitter 7*a* apparently becomes equal in potential to the gate electrode 4*b* to cause the large voltage applied between the emitter and the cathode electrode (and the p-type silicon substrate 1), a depletion layer expands to cause the pinch-off in the neighborhood of the emitter 7*a* so that the current greater than a saturation current value of the pinch-off resistor does not flow in the emitter 7*a*. By setting the saturation current value of the pinch-off resistor to be smaller than a melting current value for a material of the emitter, the short-circuited damage upon discharge can be prevented. On the other hand, since the high voltage is applied to the pinch-off resistor in the form of the n-type diffused layer 2 upon discharge, it is necessary to set a length of the pinch-off resistor such that the electric field intensity applied to both ends of the pinch-off resistor becomes smaller than the breakdown electric field intensity of silicon. Since the n-type diffused layer 2 is formed as extending laterally, a length of the pinch-off resistor between the emitter 7*a* and the cathode electrode 4*a* can be easily adjusted. Further, even if the cathode electrode 4*a* and the substrate electrode 8 are set equal in potential to each other, a desired current characteristic can be achieved. It is not necessary to provide the power supply as required for setting the voltage applied to the p-type silicon substrate 1, and only those power supplies for the gate electrode, the cathode electrode and the anode electrode (not shown) necessary for the electric field emission cold cathode are sufficient. Thus, the element having the saturation current characteristic function can be provided without increasing the loads of the device.

Now, examples of this invention will be described with reference to the drawings.

Figure 4A:
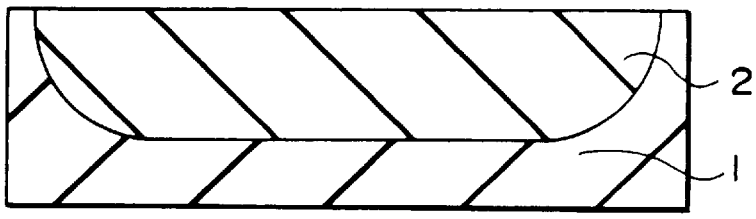
FIGS. 4A to 4E are sectional views for explaining fabricating processes of an electric field emission cold cathode according to a first example of this invention.
Figure 4B:
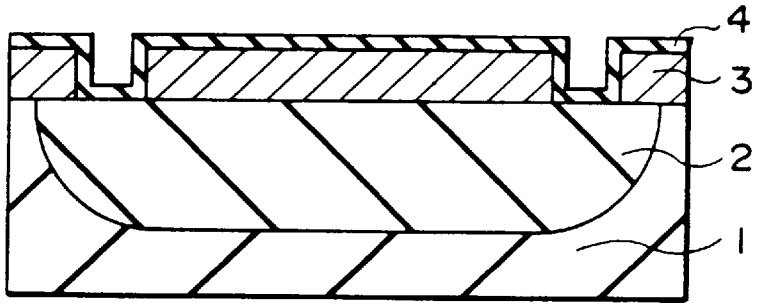
Figure 4C:
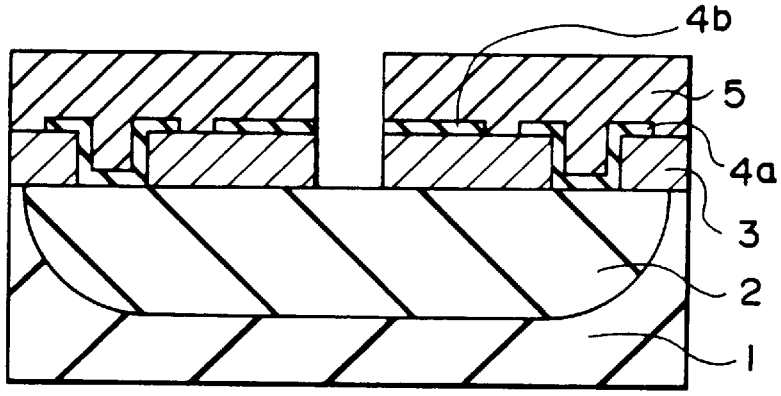
Figure 4D:
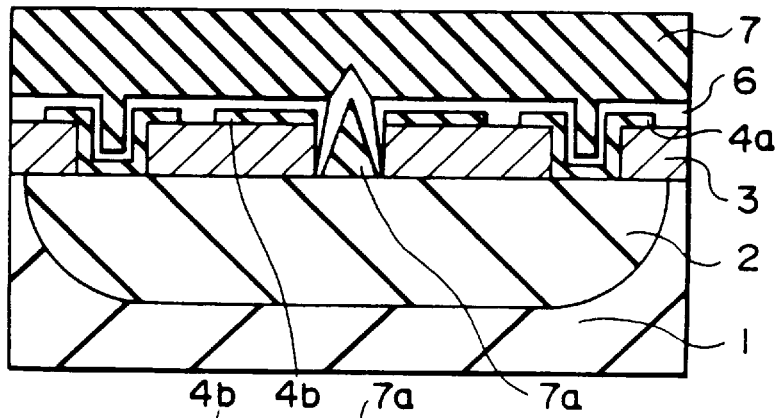
Figure 4E:
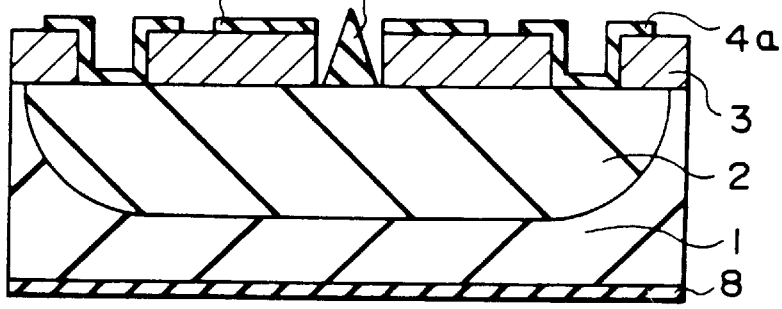

FIGS. 4A to 4E are sectional views for explaining fabricating processes of an electric field emission cold cathode according to the first example of this invention. First, as shown in FIG. 4A, phosphorus (P) atoms, for example, are doped into the surface of a p-type silicon substrate 1 of a concentration of about $10^{15}cm^{-3}$ through ion implantation using an oxide film (not shown) or the like as a mask and through thermal diffusion to form an n-type diffused layer 2 of a concentration of about $10^{15}cm^{-3}$ having a thickness of about 5 $\mu$m. Then, as shown in FIG. 4B, after forming an insulation film 3 of a thickness of about 500 nm using an oxide film formed through thermal oxidation or the like, apertures are formed through the insulation film 3 so as to selectively expose the n-type diffused layer 2, and subsequently, an electrode film 4 in the form of a metal film of W or the like is deposited thereon through sputtering or the like to have a thickness of about 200 nm. Then, as shown in FIG. 4C, the electrode film 4 is selectively etched using a mask, such as a resist, to form a cathode electrode 4*a* and a gate electrode 4*b*. Subsequently, a resist 5 is deposited thereon and then formed with circular apertures over the gate electrode 4*b* through photolithography. Thereafter, the gate electrode 4*b* and the insulation film 3 are etched through reactive ion etching (RIE) using the resist 5 as a mask. Then, as shown in FIG. 4D, a sacrifice layer 6 of aluminum is deposited through electron-beam vapor deposition along a direction inclined by a given angle relative to the vertical direction to have a thickness of about 100 nm. In this process, since the sacrifice layer 6 is deposited slantly from above, it is not formed on exposed portions of the n-type diffused layer 2 which become emitter forming regions, but formed on the side walls of the insulation film 3 and the side walls and the upper surfaces of the cathode electrode 4*a* and the gate electrode 4*b*. Subsequently, an emitter material layer 7 of Mo or the like is deposited through electron-beam vapor deposition along the vertical direction. In this process, the emitter material layer 7 is grown on the sacrifice layer 6 and the n-type diffused layer 2 and takes the shape of cone on the n-type diffused layer 2 to form a plurality of emitters 7*a* (only one is shown). Then, as shown in FIG. 4E, the sacrifice layer 6 is removed through etching in a solution of phosphoric acid or the like. Through this process, the emitter material layer 7 on the sacrifice layer 6 is lifted off and thus the emitters 7*a* are exposed. Finally, a metal film of Ti and Au or the like is deposited on the underside of the p-type silicon substrate 1 through sputtering to form a substrate electrode 8.

Figure 5:
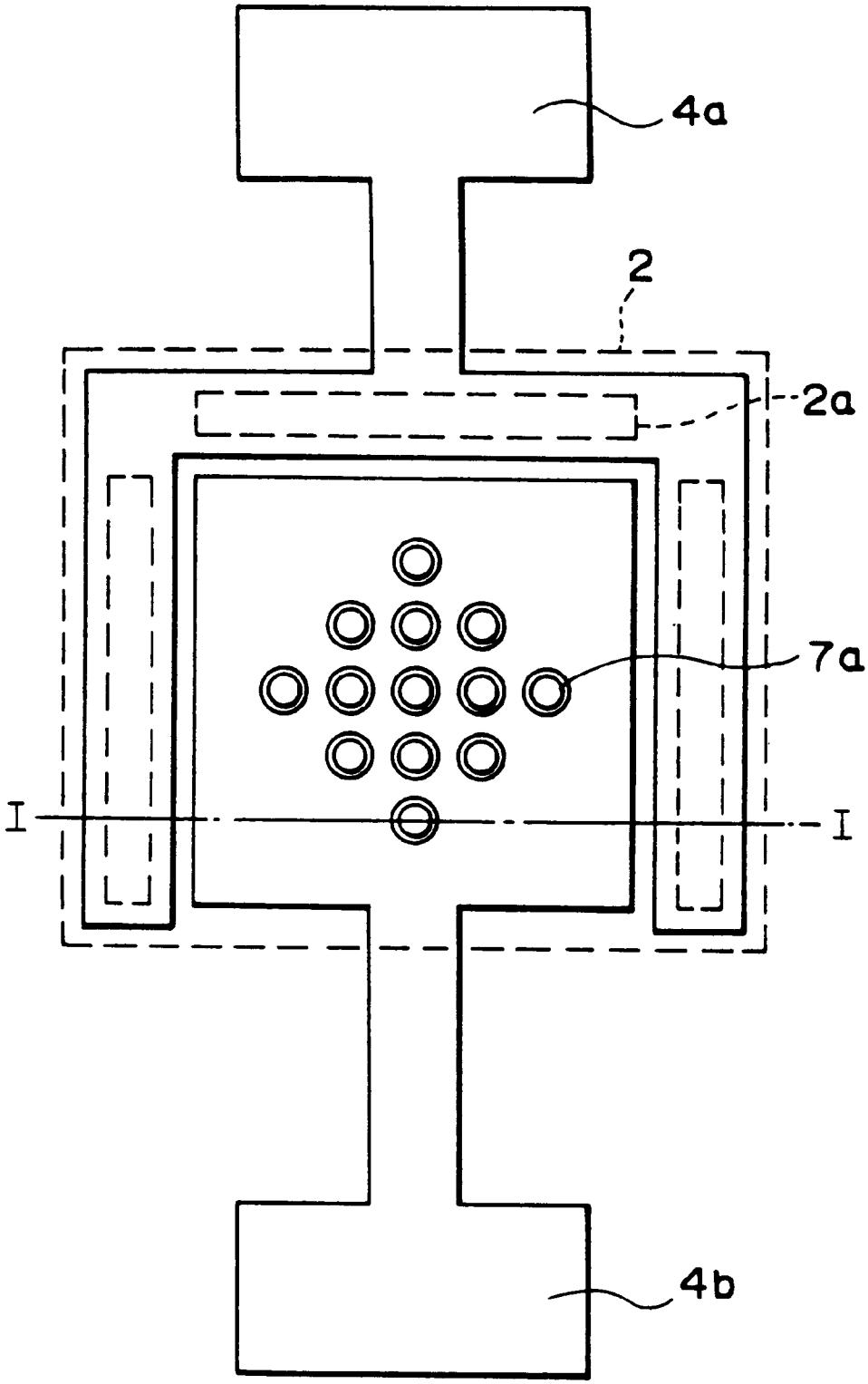
FIG. 5 is a plan view of the electric field emission cold cathode according to the first example of this invention.

FIG. 5 is a plan view of the electric field emission cold cathode according to the first example of this invention. As shown in FIG. 5, the electric field emission cold cathode has a structure, wherein the gate electrode 4*b* having openings is formed over the plurality of emitters 7*a* formed on the n-type diffused layer 2, and the cathode electrode 4*a* surrounds the gate electrode 4*b* and is connected to the n-type diffused layer 2 at cathode contact portions 2*a*. A sectional view taken along line I—I in FIG. 5 corresponds to FIG. 4E. By short-circuiting the cathode electrode 4*a* and the substrate electrode 8 via an external circuit, the n-type diffused layer 2 works as a pinch-off resistor between the emitters 7*a* and the cathode electrode 4*a*. Accordingly, the maximum value of current which flows in the emitter 7*a* is determined by a saturation current value of the pinch-off resistor. Thus, by setting the saturation current value of the pinch-off resistor so as to provide a current for the emitter which is smaller than a discharge breakdown current of the emitter, for example, 10 mA, the short-circuited damage of the element due to the melting of the emitter 7*a* upon discharge can be prevented. Further, by setting a length between the emitter 7*a* and the cathode electrode 4*a* to be not less than about 10 mm, the withstand voltage of not less than 100V can be achieved.

Figure 6A:
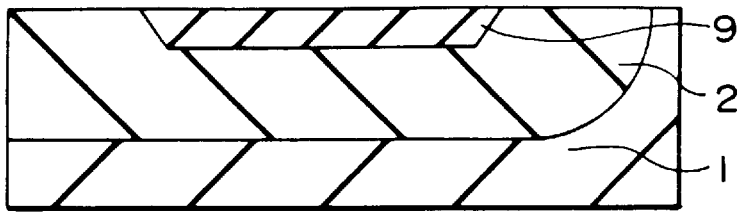
FIGS. 6A to 6E are sectional views for explaining fabricating processes of an electric field emission cold cathode according to a second example of this invention.
Figure 6B:
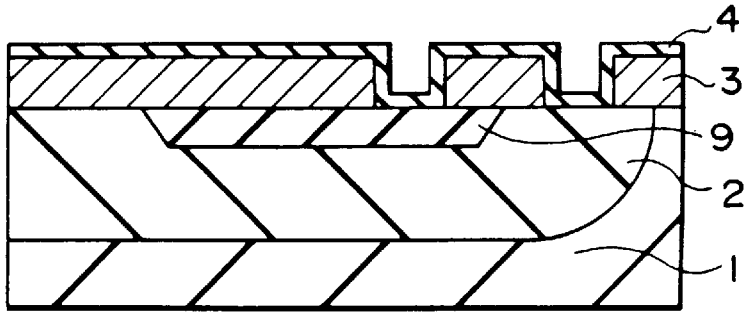
Figure 6C:
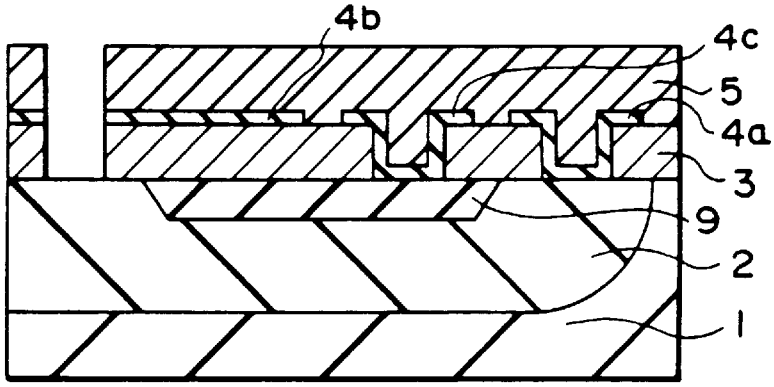
Figure 6D:
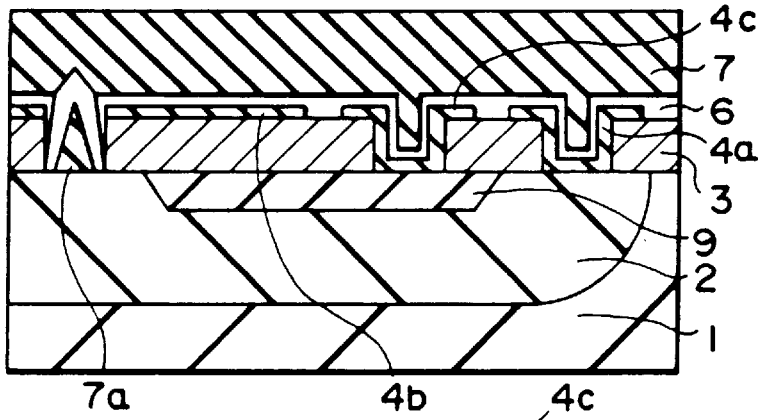
Figure 6E:
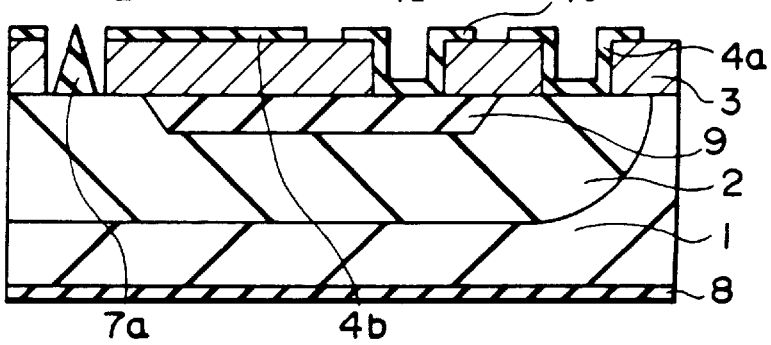

Now, the second example of this invention will be described. FIGS. 6A to 6E are sectional views for explaining fabricating processes of an electric field emission cold cathode according to the second example of this invention. First, as shown in FIG. 6A, phosphorus (P) atoms, for example, are doped into the surface of a p-type silicon substrate 1 of a concentration of about $10^{15}cm^{-3}$ through ion implantation using an oxide film (not shown) or the like as a mask and through thermal diffusion to form an n-type diffused layer 2 of a concentration of about $10^{15}cm^{-3}$ having a thickness of about 5 $\mu$m. Further, boron atoms are added into the n-type diffused layer 2 at a desired portion thereof in the concentration of about $2\times10^{15}cm^{-3}$ through ion implantation, selectively using the photolithography method, to form a p-type diffused layer 9 having a thickness of about 1 $\mu$m. Then, as shown in FIG. 6B, after forming an insulation film 3 of a thickness of about 500 nm by an oxide film formed through thermal oxidation or the like, apertures are formed through the insulation film 3 so as to selectively expose the n-type diffused layer 2 and the p-type diffused layer 9, and subsequently, an electrode film 4 in the form of a metal film of W or the like is deposited thereon through sputtering or the like to have a thickness of about 200 nm. Then, as shown in FIG. 6C, the electrode film 4 is selectively etched using a mask, such as a resist, to form cathode electrodes 4*a*, a p-type leading electrode 4*c* and a gate electrode 4*b*. Subsequently, a resist 5 is deposited thereon and then formed with circular apertures over the gate electrode 4*b* through photolithography. Thereafter, the gate electrode 4*b* and the insulation film 3 are etched through reactive ion etching (RIE) using the resist 5 as a mask. Then, as shown in FIG. 6D, a sacrifice layer 6 of aluminum is deposited through electron-beam vapor deposition along a direction inclined by a given angle relative to the vertical direction to have a thickness of about 100 nm. Subsequently, an emitter material layer 7 of Mo or the like is deposited through electron-beam vapor deposition along the vertical direction. In this process, the emitter material layer 7 is grown on the sacrifice layer 6 and the n-type diffused layer 2 and takes the shape of cone on the n-type diffused layer 2 to form a plurality of emitters 7*a* (only one is shown). Then, as shown in FIG. 6E, the sacrifice layer 6 is removed through etching in a solution of phosphoric acid or the like. Through this process, the emitter material layer 7 on the sacrifice layer 6 is lifted off and thus the emitters 7*a* are exposed. Finally, a metal film of Ti and Au or the like is deposited on the underside of the p-type silicon substrate 1 through sputtering to form a substrate electrode 8. Thereafter, by short-circuiting the p-type leading electrode 4*c*, the substrate electrode 8 and the cathode electrodes 4*a* via an external circuit, the n-type diffused layer 2 works as a pinch-off resistor between the emitters 7*a* and the cathode electrode 4*a*.

Figure 7:
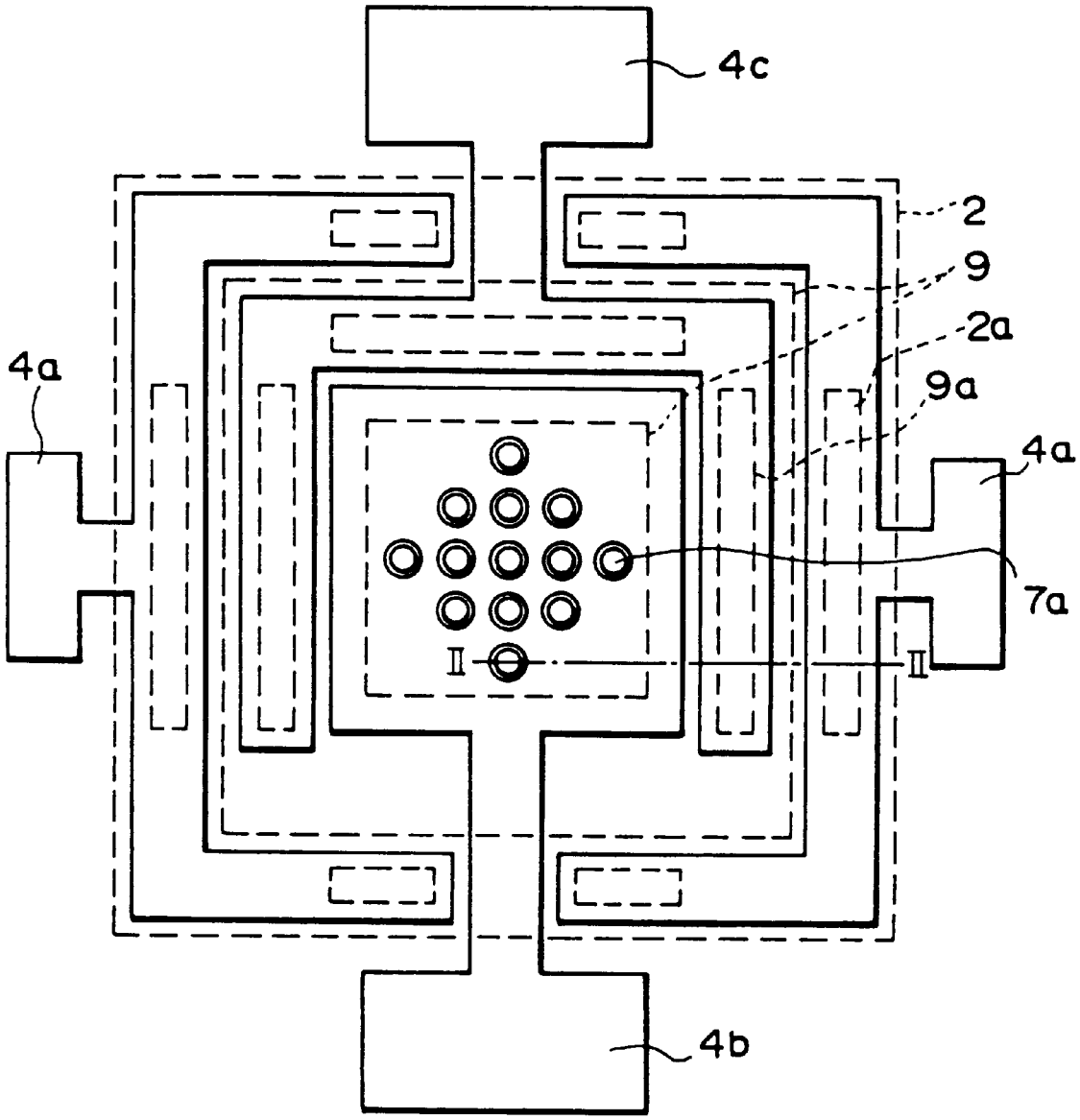
FIG. 7 is a plan view of the electric field emission cold cathode according to the second example of this invention.

FIG. 7 is a plan view of the electric field emission cold cathode according to the second example of this invention. A sectional view taken along line II—II in FIG. 7 corresponds to FIG. 6E. In the second example, although the p-type leading electrode 4*c* and the cathode electrodes 4*a* are separated and connected via the external circuit, they may be connected using electrode wiring on the element. In the second example, since the p-type diffused layer 9 is formed even at the side of the gate electrode 4*b* provided over the n-type diffused layer 2, no accumulation layer is formed at the interface between the insulation film 3 and the n-type diffused layer 2 due to an electric field from the gate electrode 4*b* so that a stable pinch-off resistance characteristic can be achieved. Further, since the n-type diffused layer 2 is sandwiched between the p-type silicon substrate 1 and the p-type diffused layer 9, the pinch-off characteristic is further improved as compared with the first example of this invention. The p-type diffused layer 9 is connected to the p-type leading electrode 4*c* at p-type diffused layer contact portions 9*a*.

Figure 8A:
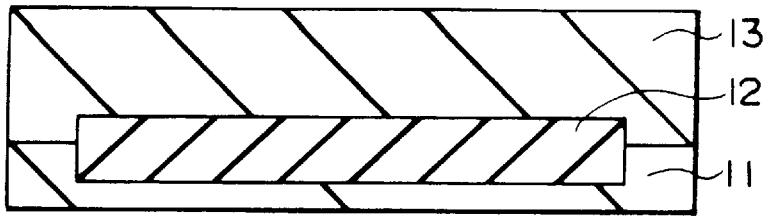
FIGS. 8A to 8E are sectional views for explaining fabricating processes of an electric field emission cold cathode according to a third example of this invention.
Figure 8B:
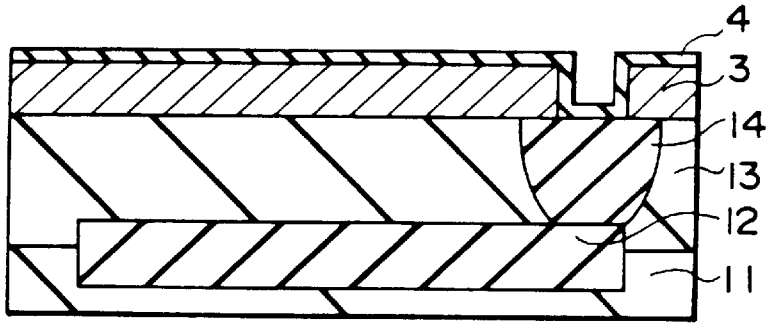
Figure 8C:
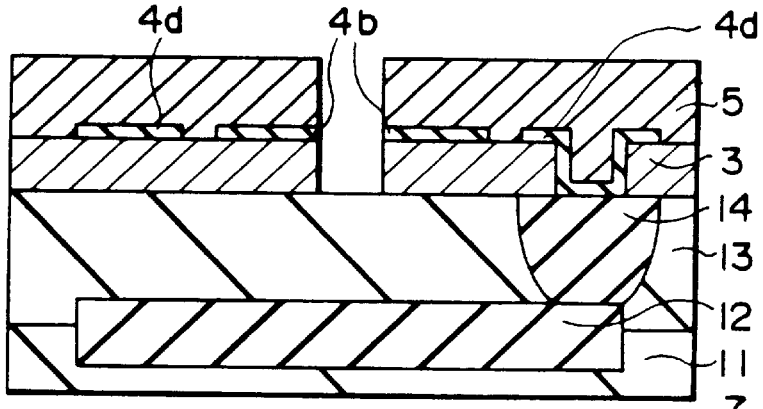
Figure 8D:
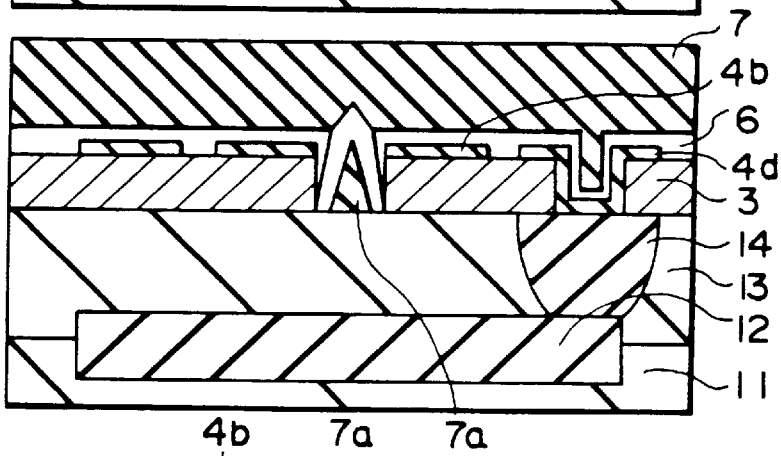
Figure 8E:
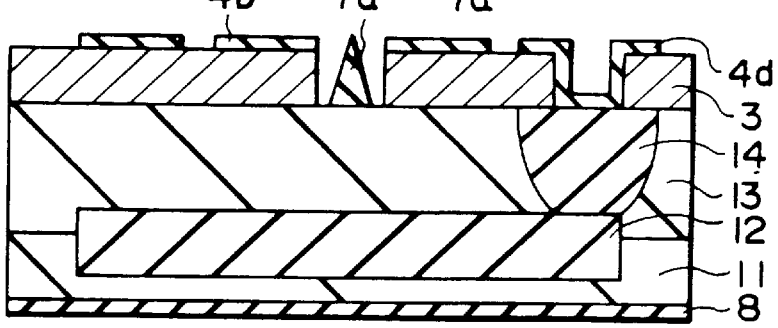

Now, the third example of this invention will be described. FIGS. 8A to 8E are sectional views for explaining fabricating processes of an electric field emission cold cathode according to the third example of this invention. First, as shown in FIG. 8A, boron atoms, for example, are doped into the surface of an n-type silicon substrate 11 of a concentration of about $10^{15}cm^{-3}$ to $10^{16}cm^{-3}$ through ion implantation using an oxide film (not shown) or the like as a mask and through thermal diffusion to form a p-type embedded layer 12 of a concentration of about $10^{15}cm^{-3}$ having a thickness of about 5 $\mu$m. Further, through epitaxial growth, an n-type epitaxial layer 13 of a concentration of about $10^{15}cm^{-3}$ is formed to a thickness of about 6 $\mu$m. Then, as shown in FIG. 8B, by selectively carrying out the ion implantation of boron using the photolithography method and further performing thermal diffusion, a p-type leading layer 14 of a concentration of about $10^{19}cm^{-3}$ is formed in the n-type epitaxial layer 13 for connection between the surface of the n-type epitaxial layer 13 and the p-type embedded layer 12. Subsequently, after forming an insulation film 3 of a thickness of about 500 nm by an oxide film formed through thermal oxidation or the like, apertures are formed through the insulation film 3 so as to selectively expose the p-type leading layer 14, and subsequently, an electrode film 4 in the form of a metal film of W or the like is deposited thereon through sputtering or the like to have a thickness of about 200 nm. Then, as shown in FIG. 8C, the electrode film 4 is selectively etched using a mask, such as a resist, to form a gate electrode 4*b* and a p-type embedded electrode 4*d*. Subsequently, a resist 5 is deposited thereon and then formed with circular apertures over the gate electrode 4*b* through photolithography. Thereafter, the gate electrode 4*b* and the insulation film 3 are etched through reactive ion etching (RIE) using the resist 5 as a mask. Then, as shown in FIG. 8D, a sacrifice layer 6 of aluminum is deposited through electron-beam vapor deposition along a direction inclined by a given angle relative to the vertical direction to have a thickness of about 100 nm. Subsequently, an emitter material layer 7 of Mo or the like is deposited through electron-beam vapor deposition along the vertical direction. In this process, the emitter material layer 7 is grown on the sacrifice layer 6 and the n-type epitaxial layer 13 and takes the shape of cone on the n-type epitaxial layer 13 to form a plurality of emitters 7*a* (only one is shown). Then, as shown in FIG. 8E, the sacrifice layer 6 is removed through etching in a solution of phosphoric acid or the like. Through this process, the emitter material layer 7 on the sacrifice layer 6 is lifted off and thus the emitters 7*a* are exposed. Finally, a metal film of Ti and Au or the like is deposited on the underside of the n-type silicon substrate 11 through sputtering to form a substrate electrode 8. Thereafter, by short-circuiting the p-type embedded electrode 4*d* and the substrate electrode 8, which becomes a cathode electrode, via an external circuit, the n-type epitaxial layer 13 on the p-type embedded layer 12 works as a pinch-off resistor.

Figure 9:
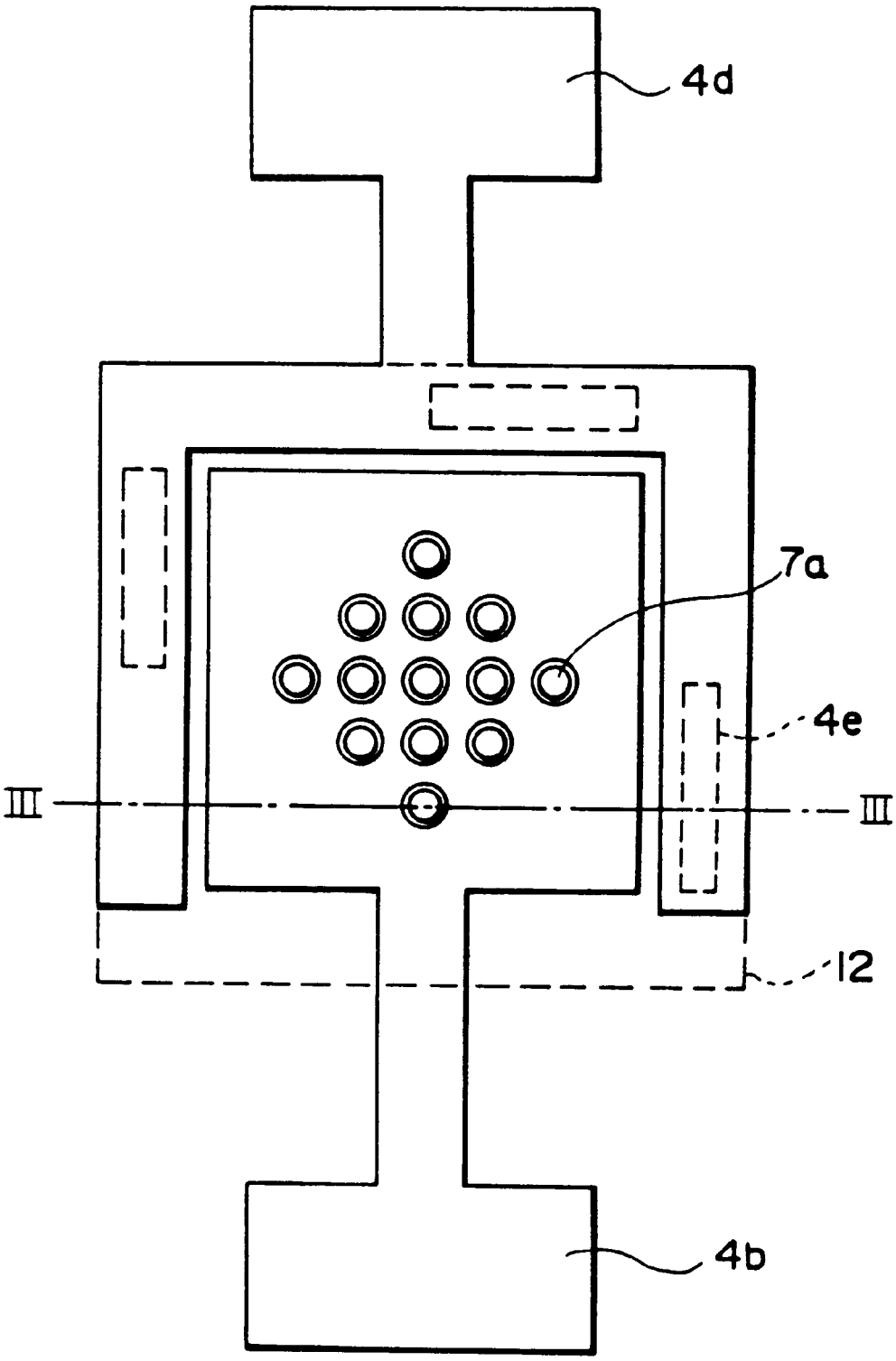
FIG. 9 is a plan view of the electric field emission cold cathode according to the third example of this invention.

FIG. 9 is a plan view of the electric field emission cold cathode according to the third example of this invention. A sectional view taken along line III—III in FIG. 9 corresponds to FIG. 8E. In the third example, the cathode electrode can be led from the underside of the element. Thus, it is not necessary to arrange leading wiring for the cathode electrode on the upper surface of the element so that the orbit of emitted electrons is prevented from changing due to influence of an electric field caused by such leading wiring. The p-type leading layer 14 is connected to the p-type embedded electrode 4*d* at embedded layer contact portions 4*e*.

In the third example, the p-type diffused layer in the second example is not formed at the side of the gate electrode 4*b* provided over the n-type epitaxial layer 13. On the other hand, the p-type diffused layer may be selectively formed on the n-type epitaxial layer 13.

Figure 10:
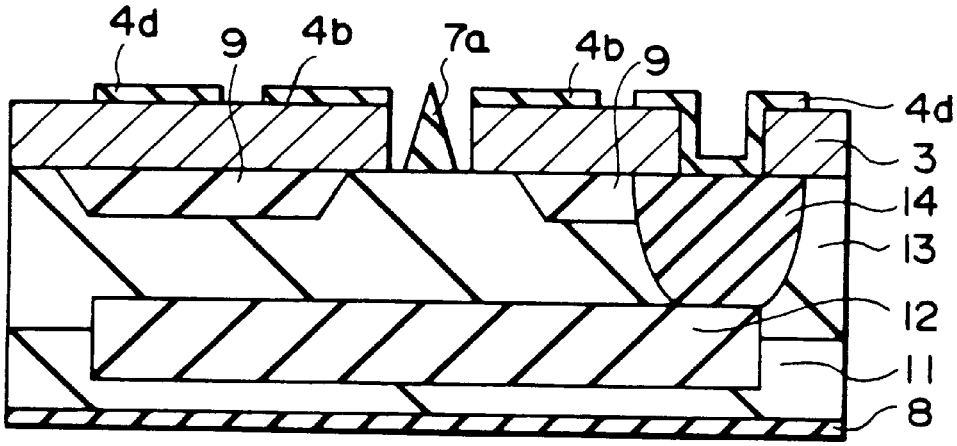
FIG. 10 is a sectional view of an electric field emission cold cathode according to a fourth example of this invention.

Now, the fourth example of this invention will be described. FIG. 10 is a sectional view of an electric field emission cold cathode according to the fourth example of this invention. In FIG. 10, a p-type embedded layer 12 of a concentration of about $10^{15}cm^{-3}$ and a thickness of about 5 $\mu$m is formed on an n-type silicon substrate 11 connected to a substrate electrode 8 which becomes a cathode electrode. Further, an n-type epitaxial layer 13 having a thickness of about 6 $\mu$m is formed on the n-type silicon substrate 11 and the p-type embedded layer 12. The p-type embedded layer 12 is connected via a p-type leading layer 14 to a p-type embedded electrode 4*d* formed on the p-type leading layer 14. Further, a p-type diffused layer 9 of a concentration of about $2\times10^{15}cm^{-3}$ is selectively formed to a thickness of about 1 $\mu$m at the surface of the n-type epitaxial layer 13 so as to be partly connected to the p-type leading layer 14. On the n-type epitaxial layer 13 and the p-type diffused layer 9 is formed an insulation film 3 in the form of an oxide film having a thickness of about 500 nm. The insulation film 3 is formed with apertures at emitter forming regions. Sharp-pointed conical emitters 7 made of Mo are formed at the apertures of the insulation film 3, and a gate electrode 4*b* is formed on the insulation film 3 so as to surround the emitters 7*a*. By short-circuiting the substrate electrode 8, which becomes a cathode electrode, and the p-type embedded electrode 4*d* or setting a potential difference therebetween to be constant, the n-type epitaxial layer 13 sandwiched between the p-type diffused layer 9 and the p-type embedded layer 12 works as a pinch-off resistor. With this arrangement, even when the cathode electrode is led from the underside of the substrate, it is possible not to produce a conductive layer at the surface of the n-type epitaxial layer under the gate electrode.

Figure 11:
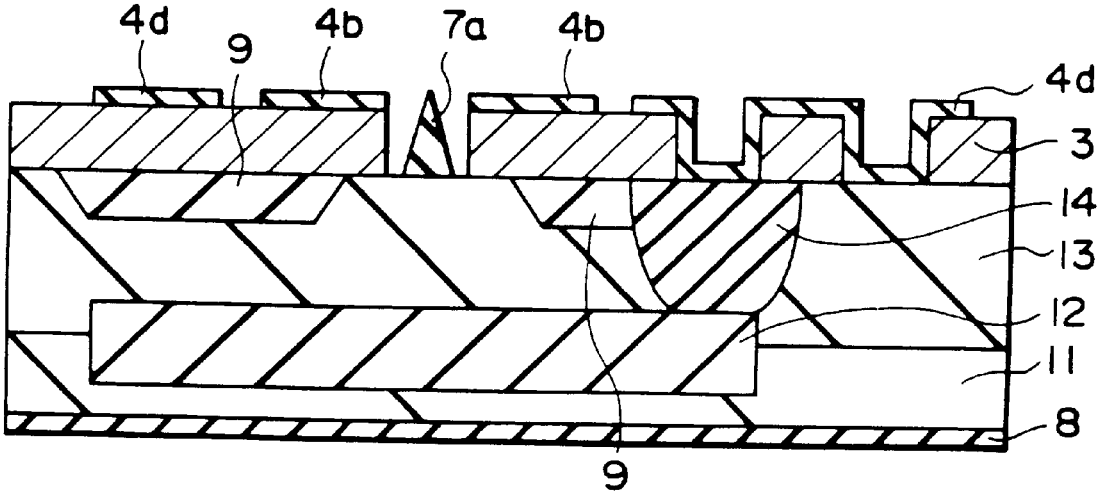
FIG. 11 is a sectional view of an electric field emission cold cathode according to a fifth example of this invention.

Now, the fifth example of this invention will be described. FIG. 11 is a sectional view of an electric field emission cold cathode according to the fifth example of this invention. In the fifth example, in addition to the connection between the p-type embedded electrode 4*d* and the p-type leading layer 14 shown in the fourth example, the p-type embedded electrode 4*d* is connected to the substrate electrode 8, which becomes a cathode electrode, via the n-type epitaxial layer 13 and the n-type silicon substrate 11. With this arrangement, the p-type diffused layer 9 and the p-type embedded layer 12 can be set substantially equal in potential to the cathode electrode on the element so that the n-type epitaxial layer 13 sandwiched between the p-type diffused layer 9 and the p-type embedded layer 12 works as a pinch-off resistor.

Figure 12:
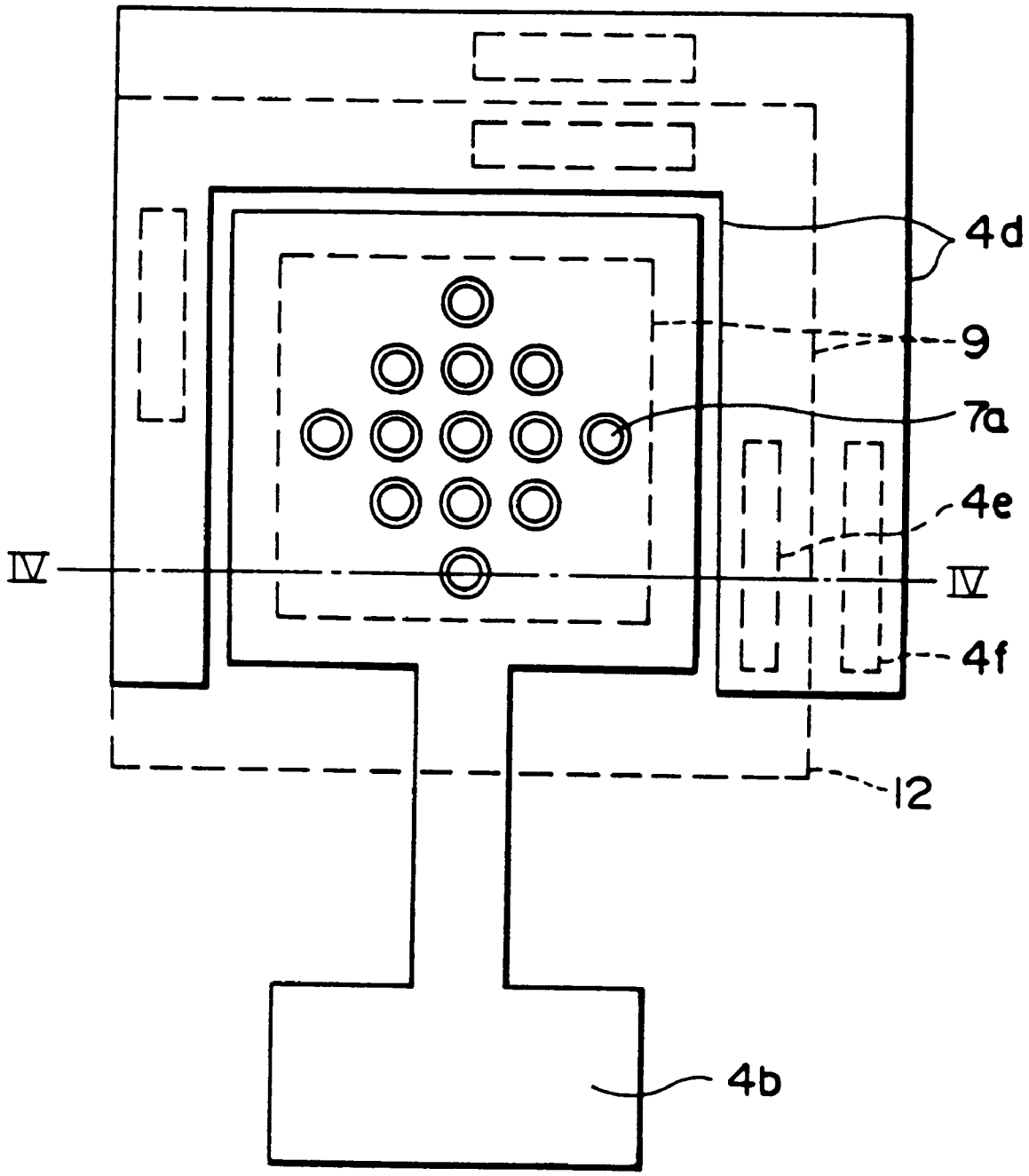
FIG. 12 is a plan view of the electric field emission cold cathode according to the fifth example of this invention.

FIG. 12 is a plan view of the electric field emission cold cathode according to the fifth example of this invention. A sectional view taken along line IV—IV in FIG. 12 corresponds to FIG. 11. As shown in FIG. 12, an embedded layer contact portion 4*e* and an epitaxial layer contact portion 4*f* are connected to the p-type embedded electrode 4*d*. The p-type leading layer 14 is connected to the p-type embedded electrode 4*d* at the embedded layer contact portion 4*e*, while the n-type epitaxial layer 13 is connected to the, p-type embedded electrode 4*d* at the epitaxial layer contact portion 4*f*. With this arrangement, since the cathode electrode, the p-type diffused layer 9 and the p-type embedded layer 12 can be led from the underside of the substrate, the gate electrode 4*b* is the only electrode to be led to the exterior from the upper side of the substrate so that mounting of the element can be simplified.

Figure 13A:
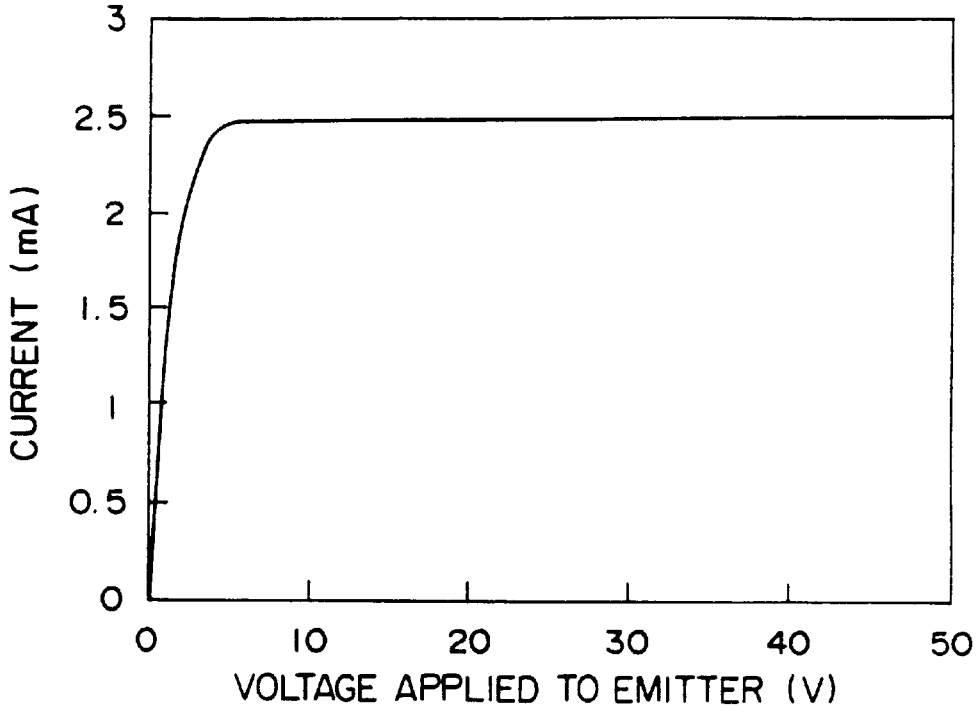
Figure 13B:
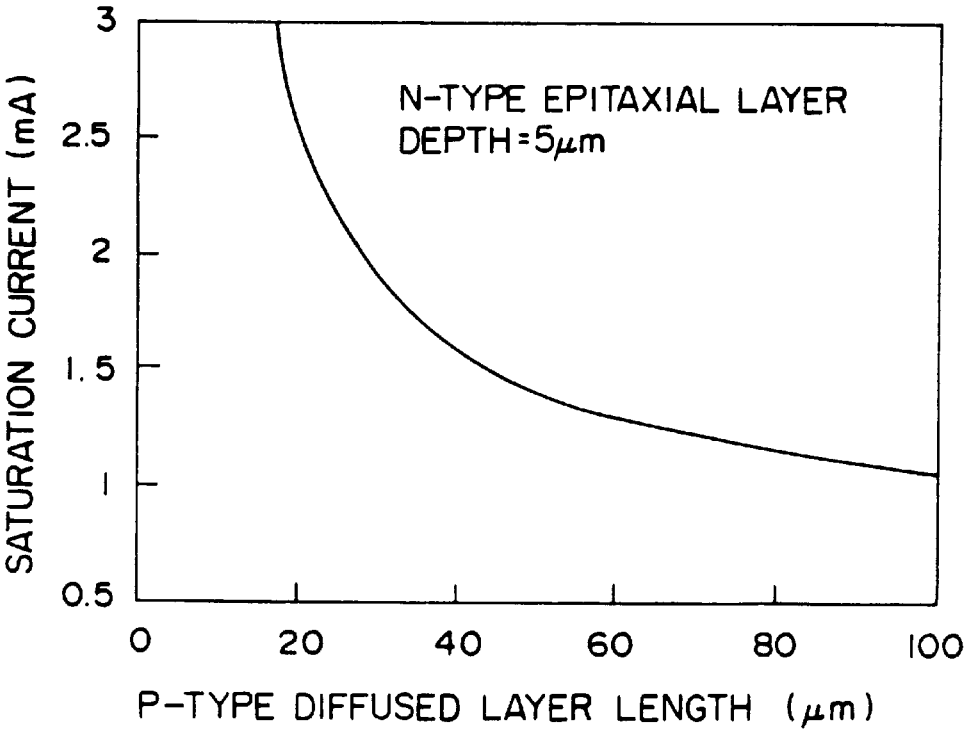

FIGS. 13A and 13B show an example of a saturation current characteristic of the pinch-off resistor in the electric field emission cold cathode of this invention. FIG. 13A shows a current characteristic when the voltage is applied to the emitter 7*a* under the conditions that the concentration of the n-type epitaxial layer 13 is $10^{15}cm^{-3}$ and the thickness thereof is 5 $\mu$m and that the length of the pinch-off resistor, that is, the length of the p-type diffused layer 9, is set to 20 $\mu$m. As shown in FIG. 13A, when the voltage greater than several volts is applied, the current becomes constant at about 2.5 mA due to the pinch-off effect. FIG. 13B shows a relationship between the length of the p-type diffused layer 9, that is, the resistance length of the pinch-off resistor, and the saturation current value thereof. As shown in FIG. 13B, the saturation current value reduces as the length of the p-type diffused layer 9 increases. Thus, by adjusting the length of the p-type diffused layer 9, the current which flows in the emitter 7*a* can be easily controlled, for example, to a value smaller than 10 mA which corresponds to the short-circuit breakdown current for the emitter made of Mo. The saturation current value can also be controlled by changing the concentration or thickness of the n-type epitaxial layer 13.

In the foregoing examples, the emitter is formed by the metal film of Mo or the like. However, the emitter material is not limited to metal. Specifically, this invention is also applicable to an electric field emission cold cathode having a sharp-pointed emitter made of silicon or an electric field emission cold cathode having an emitter formed by coating silicon with a thin metal layer. In this case, the short-circuit breakdown current upon discharge changes depending on the resistivity of the emitter material, the shape of the emitter and even the reactivity to a material of the ground layer. Further, in the foregoing description, only one pinch-off resistor in the form of the n-type diffused layer or the n-type epitaxial layer is provided for one emitter or a plurality of emitters such that the saturation current of the pinch-off resistor is set to provide a current for the emitter which is smaller than the short-circuit breakdown current of the emitter. However, this invention is also applicable to a case where a plurality of emitters are divided or split and the corresponding number of pinch-off resistors are provided therefor. Specifically, the n-type diffused layer or the n-type epitaxial layer under the emitters is divided in an insulated manner or by pn junction so as to form the element having a plurality of independent pinch-off resistors. With this arrangement, the element is applicable to a device, such as a traveling-wave tube, which requires the current value greater than the short-circuit breakdown current, for example, greater than 10 mA at which the Mo emitter is melted. Specifically, in case of the element which requires the cathode current of 50 mA, by dividing the n-type diffused layer or the n-type epitaxial layer to provide more than five pinch-off resistors, each pinch-off resistor can be set to provide a current for the emitter which is smaller than a value at which the emitter is melted.

Further, when the electric field emission cold cathode is applied to a display device as an electron gun, since the operation is normally required under vacuum, replacement thereof is difficult after incorporation of the electron gun into the display device. Particularly, in case of a flat panel display, when the element is damaged due to a short circuit upon discharge to cause the discharge current amount of the electron gun to be changed at that portion, a difference is caused relative to the peripheral luminance or a dark point remains so that operation failure of the device is resulted. In view of this, by applying the electric field emission cold cathodes, each having the saturation current characteristic achieved by the pinch-off resistance, to the flat panel display as electron guns each of which is not subjected to a short-circuited damage even upon an occurrence of discharge, the electron guns can be operated without damage so that the long-term display operation is achieved. The display device is not limited to the flat panel display, but includes a cathode ray tube (CRT) for display or the like.

What is claimed is:

1. An electric field emission cold cathode comprising a sharp-pointed emitter, a gate electrode having an aperture surrounding said emitter, and a cathode electrode connected to said emitter, wherein a pinch-off resistor having a saturation current characteristic is provided between said emitter and said cathode electrode and wherein said pinch-off resistor is formed on an n-type silicon film connected to said emitter and said cathode electrode, and wherein said n-type silicon film contacts a p-type silicon film which is electrically connected to said cathode electrode at least at a side thereof facing said emitter.

2. An electric field emission cold cathode as claimed in claim 1, wherein a p-type silicon layer electrically connected to said p-type silicon film is selectively formed at a surface of said n-type silicon film at a side of said gate electrode.

3. An electric field emission cold cathode as claimed in claim 1, wherein said pinch-off resistor has a withstand voltage not less than a voltage applied between said gate electrode and said cathode electrode and a saturation current value smaller than a short-circuit breakdown current of said emitter.

4. An electric field emission cold cathode as claimed in claim 2, wherein said pinch-off resistor has a withstand voltage not less than a voltage applied between said gate electrode and said cathode electrode and a saturation current value smaller than a short-circuit breakdown current of said emitter.

5. An electric field emission cold cathode as claimed in claim 3, wherein said n-type silicon film is formed on an n-type silicon substrate connected to said cathode electrode at an underside thereof, and on said p-type silicon film formed on said n-type silicon substrate.

6. An electric field emission cold cathode as claimed in claim 5, wherein said p-type silicon film and said n-type silicon film are connected via a metal electrode at an upper side of said n-type silicon substrate.

7. An electric field emission cold cathode as claimed in claim 4, wherein said n-type silicon film is formed on an n-type silicon substrate connected to said cathode electrode at an underside thereof, and on said p-type silicon film formed on said n-type silicon substrate.

8. An electric field emission cold cathode as claimed in claim 7, wherein said p-type silicon film, said p-type silicon layer and said n-type silicon film are connected via a metal electrode at an upper side of said n-type silicon substrate.

* * * * *